US009735467B2

(12) United States Patent
Hwang et al.

(10) Patent No.: US 9,735,467 B2
(45) Date of Patent: Aug. 15, 2017

(54) ANTENNA

(71) Applicant: FOXCONN INTERCONNECT TECHNOLOGY LIMITED, Grand Cayman (KY)

(72) Inventors: Tzu-Yao Hwang, New Taipei (TW); Lung-Sheng Tai, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 178 days.

(21) Appl. No.: 14/619,090

(22) Filed: Feb. 11, 2015

(65) Prior Publication Data

US 2015/0236407 A1 Aug. 20, 2015

(30) Foreign Application Priority Data

Feb. 17, 2014 (TW) ..... 103105020 A

(51) Int. Cl.

| | |
|---|---|
| ***H01Q 1/38*** | (2006.01) |
| ***H01Q 1/48*** | (2006.01) |
| ***H01Q 1/50*** | (2006.01) |
| ***H01Q 7/00*** | (2006.01) |

(52) U.S. Cl.
CPC ..... *H01Q 1/48* (2013.01); *H01Q 1/50* (2013.01); *H01Q 7/00* (2013.01)

(58) Field of Classification Search
CPC ..... H01Q 1/38
USPC ..... 343/700 MS
See application file for complete search history.

(56) References Cited

FOREIGN PATENT DOCUMENTS

| | | |
|---|---|---|
| CN | 103633418 A | 3/2014 |
| TW | M367434 U1 | 10/2009 |
| TW | 201249001 | 12/2012 |

*Primary Examiner* — Graham Smith
(74) *Attorney, Agent, or Firm* — Wei Te Chung; Ming Chieh Chang

(57) ABSTRACT

An antenna includes a grounding portion extending in a longitudinal direction and defining a first end and a second end opposite to each other, a first arm extending from the first end of the grounding portion and towards the second end and defining a first slot with the grounding portion, and a second arm extending from the second end of the grounding portion and towards the first end and defining a second slot. The first arm includes a free end close to the second end defining an opening between the free end and the second end. A coaxial cable includes an inner conductor and an outer conductor, which connects the free end of the first arm and the second end of the grounding portion, respectively, to form a loop around the first slot.

6 Claims, 3 Drawing Sheets

ANTENNA

BACKGROUND OF THE INVENTION

1. Field of the Invention

The present invention relates to an antenna, and more particularly to an antenna capable of wireless data transmission.

2. Description of Prior Arts

With the development of electronic technology, more and more mobile electronic devices have wireless transceivers inside for wireless transmitting signal, and antennas are often integrated in the mobile electronic devices. With the miniaturization development of the electronic devices, an internal space of the electronic device becomes smaller, so the size of the antenna becomes smaller, but the performance requirement still becomes higher and higher. However, because traditional Planar Inverted-F Antenna is sensitive to the surrounding environment, the performance of the Planar Inverted-F Antenna is limited under the miniaturization development.

A small size antenna with high performance is desired.

SUMMARY OF THE INVENTION

An antenna comprises a grounding portion extending in a transverse direction defining a first end and a second end opposite to each other. The antenna comprises a first arm and a second arm. A first arm extends from the first end of the grounding portion and towards the second end, the first arm and the grounding portion define a first slot therebetween, the first arm has a free end closed to the second end defining an opening therebetween. A second arm extends from the second end of the grounding portion and towards the first end, the second arm is located outside of the first arm, the second arm and the first arm define a second slot therebetween. The antenna also includes a coaxial cable. A coaxial cable comprises an inner conductor and an outer conductor, the inner conductor and the outer conductor connect the free end of the first arm and the second end of the grounding portion to form a loop around the first slot, or the inner conductor and the outer conductor connect the free end of the first arm and the second arm to form a loop around the first slot.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
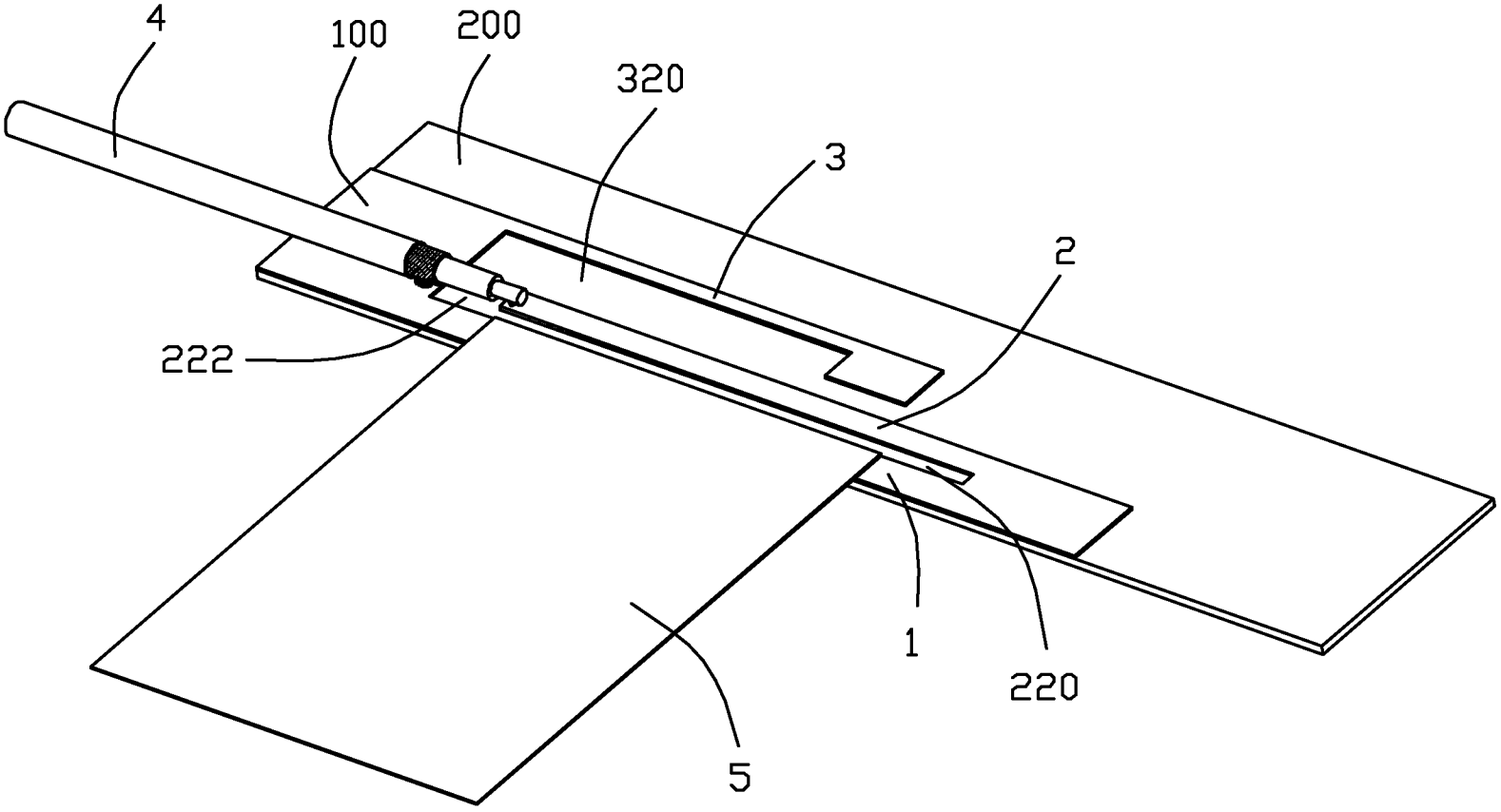
FIG. 1 is a perspective view of an antenna in accordance with the present invention.

Reference will now be made to the drawing figures to describe the present invention in detail.

FIG. 1 shows an antenna 100 extending in a longitudinal direction. The antenna 100 includes a main body, and a coaxial cable 4 and a metal foil 5 connecting the main body. The main body includes a grounding portion 1, a first arm 2 and a second arm 3 extending from the grounding portion 1. In this embodiment, the main body is etched on a base plate 200. In other embodiments, the main body can be stamped by a metal sheet, and the whole main body is located in one same plane.

Figure 2:
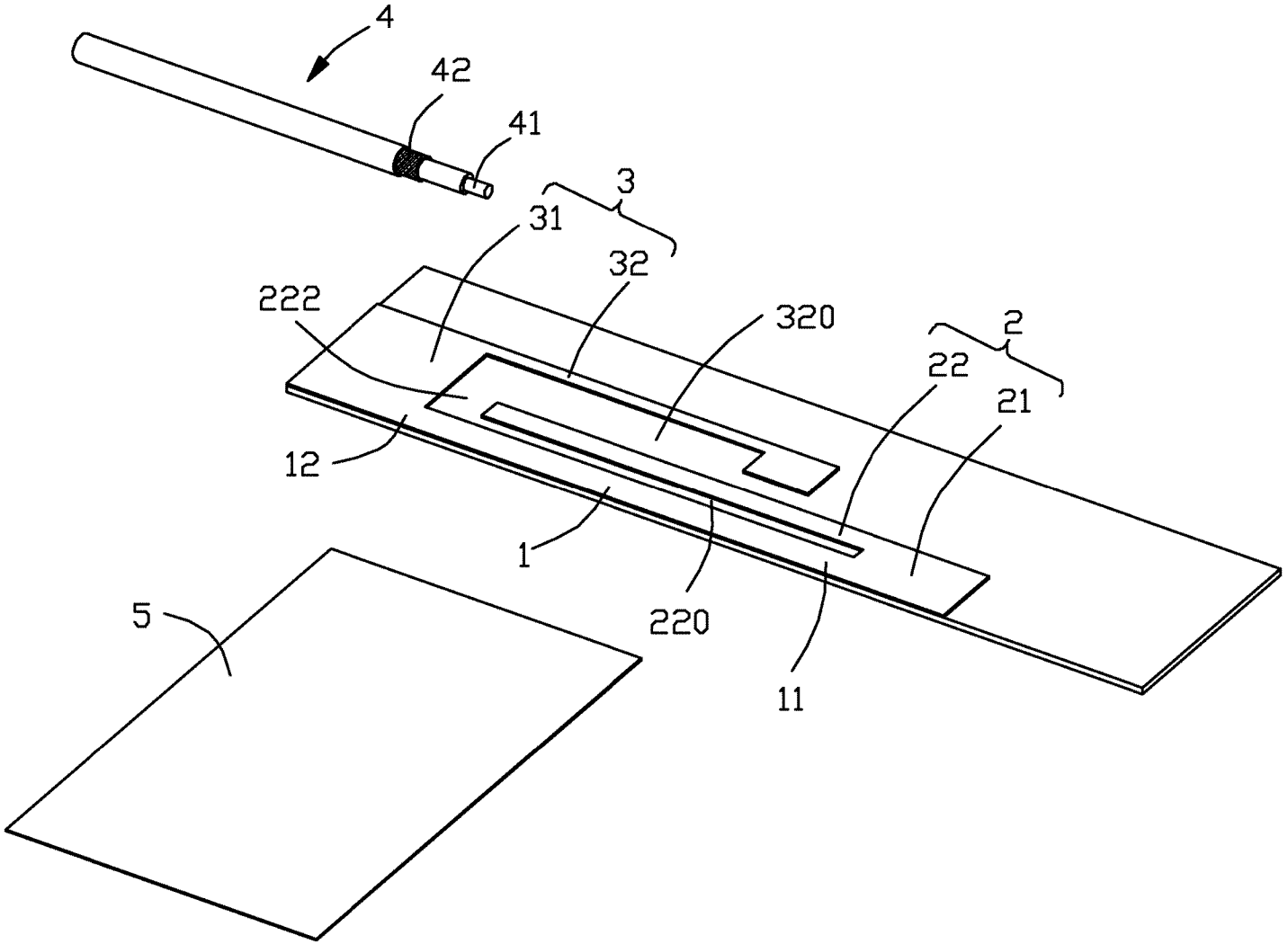
FIG. 2 is an exploded view of the antenna as shown in FIG. 1.

FIG. 2 shows the grounding portion 1 extending in a transverse direction and defining a first end 11 and a second end 12 opposite to each other. The first arm 2 extends from the first end 11 and includes a first vertical arm 21 and a first transverse arm 22. The first vertical arm 21 extends forwardly from a front edge of the grounding portion 1. The first transverse arm 22 extends from the first vertical arm 21 towards the second end 12 of the grounding portion 1, the first transverse arm 22 has a free end 23 closed to the second end 12 of the grounding portion 1. The first transverse arm 22 and the grounding portion 1 define a first slot 220 with the grounding portion 1. The second arm 3 extends from the second end 12 of the grounding portion 1 and includes a second vertical arm 31 and a second transverse arm 32, the second transverse arm 32 extends from the second vertical arm 31 towards the first end 11 of the grounding portion 1, the second transverse arm 32 and the first transverse arm 22 define a second slot 320 therebetween. The free end 23 of the first transverse arm 22 and the second vertical arm 31 define an opening 222 therebetween.

The coaxial cable 4 includes an inner conductor 41 and an outer conductor 42 surrounding the inner conductor 41. The coaxial cable 4 connects the free end 23 of the first transverse arm 22 and a part of the second vertical arm 31 near the second end 12 of the grounding portion 1 by connecting two opposite edges of the opening 222, the first arm 2 and the grounding portion 1 form a loop around the first slot 220. In this embodiment, the inner conductor 41 connects the free end 23 of the first transverse arm 22 to form signal feed-in point, the outer conductor 42 connects the second vertical arm 31 closed to the second end 12 of the grounding portion 1 to form grounding feed-in point. Of course, in other embodiments, the outer conductor 42 can connect the grounding portion 1 directly. Planar Inverted-F Antenna is sensitive to metal of the environment, so a height of the antenna is requisitely at least 7 mm, and a loop antenna of the present invention can avoid this problem.

Figure 3:
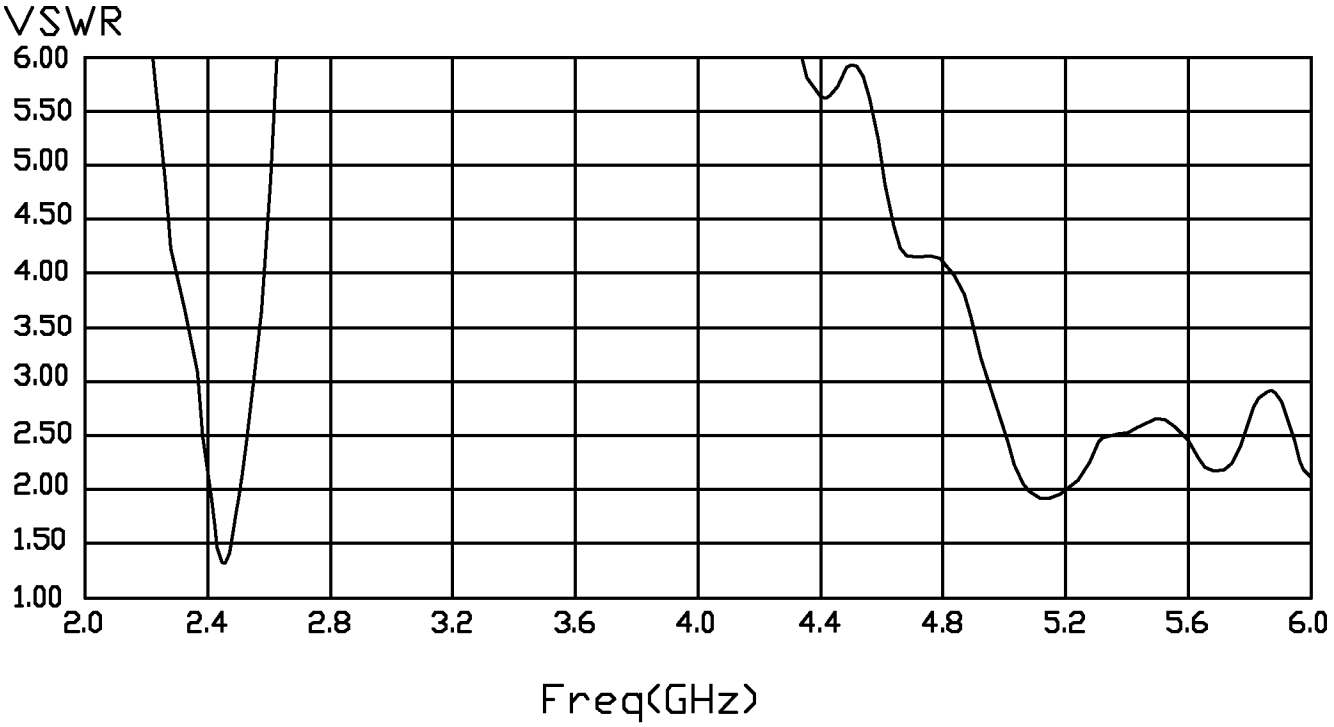
FIG. 3 shows a Voltage Standing Wave Ratio of the antenna as shown in FIG. 2.

In this embodiment, the grounding portion 1, the first arm 2 and the second arm 3 are located in a same plane, the second vertical arm 31 is higher than the first vertical arm 21 observed from a top side, the first arm 2 is located between the grounding portion 1 and the second arm 3. A length of the grounding portion 1 in the transverse direction is 28.6 mm and a height of the second vertical arm 31 is 6 mm, and a height of the first vertical arm 21 is essentially one half of that of the second vertical arm 31 by reference to FIGS. 1 and 2. FIG. 3 is a Voltage Standing Wave Ratio Chart of the antenna 100 in accordance with the present invention, a loop antenna formed by the first arm 2 and the grounding portion 1 works in a low frequency band, and the second arm 3 works in a high frequency band by coupling, the size of the antenna is small, this can meet the demand of miniaturization development.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna consisting essentially of:

a grounding portion extending in a transverse direction defining a first end and a second end opposite to each other;

a first arm extending from the first end of the grounding portion and towards the second end, the first arm and the grounding portion defining a first slot therebetween, the first arm having a free end close to the second end and defining an opening between the free end and the second end;

a second arm extending from the second end of the grounding portion and towards the first end, the second arm located outside of the first arm, the second arm and the first arm defining a second slot therebetween; and a coaxial cable comprising an inner conductor and an outer conductor, the inner conductor and the outer conductor connecting the free end of the first arm and the second end of the grounding portion, respectively, to form a loop around the first slot, or the inner conductor and the outer conductor connecting the free end of the first arm and a part of the second arm near the second end of the grounding portion, respectively, to form a loop around the first slot; wherein the outer conductor connects the second end of the grounding portion to form a grounding feed-in point, and the inner conductor connects the free end of the first arm to form a signal feed-in point; wherein the first arm and the second arm are located in a same plane, and the first arm is located between the grounding portion and the second arm; wherein the first arm has a first vertical arm connecting to the first end of the grounding portion and a first transverse arm extending from the first vertical arm towards the second end of the grounding portion; wherein the second arm has a second vertical arm connecting to the second end of the grounding portion and a second transverse arm extending from the second vertical arm towards the first end of the grounding portion; wherein the outer conductor connects the second vertical arm to form a grounding feed-in point; wherein the second vertical arm is higher than the first vertical arm; wherein a length of the grounding portion in a transverse direction is 28.6 mm, a height of the second vertical arm is 6 mm; wherein a length of the second arm in a transverse direction is smaller than a length of the grounding portion in the transverse direction; wherein a loop antenna formed by the first arm and the grounding portion works in a low frequency band, and the second arm works in a high frequency band by coupling.

2. An antenna consisting essentially of:

a grounding portion extending in a transverse direction defining a first end and a second end opposite to each other;

a first arm extending from the first end of the grounding portion and towards the second end, the first arm and the grounding portion defining a first slot therebetween, the first arm having a free end close to the second end and defining an opening with the second end therebetween;

a second arm extending from the second end of the grounding portion and towards the first end, the second arm and the first arm defining a second slot therebetween, the first arm and the second arm located in a same plane, the first arm located between the grounding portion and the second arm; and a coaxial cable comprising an inner conductor and an outer conductor, the inner conductor and the outer conductor connecting the free end of the first arm and the second end of the grounding portion, respectively, to form a loop around the first slot, or the inner conductor and the outer conductor connecting the free end of the first arm and the second arm, respectively, to form a loop around the first slot; wherein the first arm has a first vertical arm connecting to the first end of the grounding portion and a first transverse arm extending from the first vertical arm towards the second end of the grounding portion; wherein the second arm has a second vertical arm connecting to the second end of the grounding portion and a second transverse arm extending from the second vertical arm towards the first end of the grounding portion; wherein the second vertical arm is higher than the first vertical arm; wherein a length of the second arm in the transverse direction is smaller than a length of the grounding portion in the transverse direction; where a length of the grounding portion is essentially 28.6 mm, and a height of the second vertical arm is essentially 6 mm.

3. An antenna consisting essentially of:

a grounding portion extending along a transverse direction and defining opposite first and second ends thereof along a transverse direction;

a first radiation section and a second radiation section extends upwardly from opposite first and second ends, respectively, in a vertical direction perpendicular to said transverse direction;

the first radiating section including a first vertical arm joined at the front end, and a first transverse arm extending from an upper end of the first vertical arm toward the second radiating section;

the second radiating section including a second vertical arm joined at the second end, and a second transverse arm extending from an upper end of the second vertical arm toward the first radiating section;

a first horizontal slot formed between the grounding portion and the first transverse arm in the vertical direction;

a second horizontal slot formed between the first transverse arm and the second transverse arm in the vertical direction;

an opening formed between a free end of the first transverse arm and the second vertical arm in the transverse direction; and a cable including an inner conductor connected to the free end of the first transverse arm and an outer conductor connected to the second vertical arm around a position beside said opening in said transverse direction; wherein said the second vertical arm extends higher than the first vertical arm while the second transverse arm extends shorter than the first transverse arm; wherein a free end of the second transverse arm is equipped with a downwardly protruding section so as to form a narrowed opening with the second horizontal slot to communicate with an exterior in said transverse direction; wherein a metallic foil attached to the grounding portion and extending in the vertical direction, while the cable extends in the transverse direction; wherein said grounding portion is dimensioned essentially with 28.6 mm in the transverse direction, and the second vertical arm is dimensioned essentially with 6 mm in the vertical direction.

4. The antenna as claimed in claim 1, wherein a height of the first arm is essentially one half of that of the second arm.

5. The antenna as claimed in claim 2, wherein a height of the first arm is essentially one half of that of the second arm.

6. The antenna as claimed in claim 3, wherein a height of the first vertical arm is essentially one half of that of the second vertical arm.

* * * * *